United States Patent [19]

Wyatt

[11] 4,433,356

[45] Feb. 21, 1984

[54] CONTROL CIRCUIT FOR TRANSFORMER RELAY

[75] Inventor: Gerald A. Wyatt, Shoreview, Minn.

[73] Assignee: Minnesota Mining and Manufacturing Company, St. Paul, Minn.

[21] Appl. No.: 369,837

[22] Filed: Apr. 19, 1982

[51] Int. Cl.[3] ..... H01H 51/30; H01H 47/00

[52] U.S. Cl. ..... 361/191; 361/209

[58] Field of Search ..... 361/209, 208, 191, 153, 361/204, 206, 160; 307/296 R; 340/825.18

[56] References Cited

U.S. PATENT DOCUMENTS

| | | | |
|---|---|---|---|
| 2,427,751 | 9/1947 | Snyder . | |
| 3,461,354 | 8/1969 | Bollmeier | 361/209 |
| 4,234,920 | 11/1980 | Van Ness et al. . | |
| 4,260,907 | 4/1981 | Winebarger . | |
| 4,321,652 | 3/1982 | Baker et al. | 361/209 |
| 4,338,649 | 7/1982 | Mosier | 361/160 X |

FOREIGN PATENT DOCUMENTS

| | | |
|---|---|---|
| 9549A | 6/1979 | United Kingdom . |
| 80064A | 6/1982 | United Kingdom . |

*Primary Examiner*—Reinhard J. Eisenzopf

*Attorney, Agent, or Firm*—Donald M. Sell; James A. Smith; William D. Bauer

[57] ABSTRACT

A control circuit for a transformer relay which will automatically momentarily control the transformer relay to a selected state upon energization of the control circuit. The control circuit has an energy storage element and a current director coupled in series and adapted to be coupled with the secondary winding of the transformer relay. A device for discharge is coupled across the energy storage element. The energy storage element and current director will momentarily allow a unidirectional flow of current in the secondary winding of the transformer relay upon application of energy to the control circuit. When energy is not applied to the control circuit the device for discharge will allow the energy storage element to discharge and be available for another operation of the control circuit.

18 Claims, 4 Drawing Figures

CONTROL CIRCUIT FOR TRANSFORMER RELAY

BACKGROUND OF THE INVENTION

The present invention relates generally to control circuits for transformer relays and more particularly to circuits which control the transformer relay upon energization of the primary winding or the secondary winding of the transformer relay.

Transformer relays of the type contemplated to be controlled by the control circuit of the present invention are available in the art. An example is U.S. Pat. No. 3,461,354, Bollmeier, Magnetic Remote Control Switch, issued Aug. 12, 1969, which describes a dual stable state magnetically latchable transformer relay having a primary winding and a secondary winding with the stable state of the transformer relay being determined by the unidirectional flow of current in the secondary winding above a predetermined threshold. The control system for the transformer relay is a rectifier coupled in series with a double pole, double throw momentary action switch which allows the rectifier to be momentarily coupled in either direction across the secondary winding of the transformer relay. Another transformer relay with which the control circuit of the present invention may be utilized is illustrated in U.S. Pat. No. 4,321,652, Baker et al., Low Voltage Transformer Relay, issued Mar. 23, 1982. Baker et al. also discloses a dual stable state magnetically latchable transformer relay having a primary winding and a secondary winding with the direction of a unidirectional flow of current in the secondary winding controlling the state of the transformer relay. The control system disclosed in Baker et al is a single pole, double throw momentary action switch coupled with a pair of diodes, one in each direction, to allow a unidirectional current flow in the secondary winding of the transformer relay in either direction. The transformer relays in both Bollmeier and Baker et al. are magnetically latched to either of two stable states. The control of the state of the transformer relay is provided by the unidirectional flow of current in the secondary winding above a predetermined threshold. A momentary flow in one direction will control the transformer relay to an "on" state (closing a load switch) and a momentary flow of current in the other direction will cause the transformer relay to be controlled to an "off" state (opening a load switch).

A control system for a transformer relay as described in Bollmeier and Baker et al. is described in U.S. Pat. No. 4,338,649, Mosier, A System for Remotely Controlling A Load, issued July 6, 1982. The control systems described in Mosier provide control of a single transformer relay from a plurality of switches or controls.

Another control circuit for a transformer relay is disclosed in U.S. Pat. No. 4,384,314, Doty et al., Control System For Plural Transformer Relays, issued May 17, 1983. The control system in Doty et al. provides electrical isolation for a plurality of transformer relays.

In certain situations it may be necessary to automatically control the transformer relay to a particular predetermined state. For example, if the power source supplying the primary winding of the transformer relay fails or is disconnected, upon reinstatment of that power source it may be desirable or necessary to shut down certain electrical equipment. This may be the case, for example, where the transformer relay controls electrical motors driving air conditioning compressors. Further, if the power source connected to the primary winding of the transformer relay momentarily fails, it may be desirable to set an indicator to indicate this condition. With certain loads connected it may be desirable to check the proper functioning of the equipment following a momentary loss in power.

SUMMARY OF THE INVENTION

The present invention provides a control circuit adapted to cooperate with a transformer relay. The transformer relay has a primary winding adapted to be coupled to an alternating current energy source, has a load switch adapted to control the application of the energy source to a load, and has a secondary winding which controls the load switch to a selected position depending on the direction of current flow in the secondary winding. The circuit provides an energy storage element for momentarily allowing current flow upon application of energy before becoming charged, a current director for allowing a flow of current in one direction only and a device for discharging the energy stored in the energy storage element while the control circuit is not activated. The energy storage element and the current director are coupled in series and are adapted to be coupled along with the secondary winding of the transformer relay. Connected in this fashion the energy store and the current director will momentarily allow current to flow above the predetermined threshold in a selected direction in the secondary winding upon activation of the control circuit. In this way the load switch of the transformer relay can be controlled to a selected position upon activation of the control circuit.

In a preferred embodiment the energy store is a capacitor, the current director is a diode and the device for discharging is a resistor.

When this control circuit is coupled across the secondary winding of the transformer relay, the capacitor (energy storage element) will charge whenever the energy source is applied to the primary winding of the transformer relay. Thus, the control circuit will automatically set or reset the transformer relay upon the application of the energy source to the transformer relay. This may occur, for example, upon initial power up of the energy source supplying the transformer relay, upon the reapplication of the energy source following a power failure, or upon a resetting of a circuit breaker in a circuit containing the transformer relay. The transformer relay may be either set or reset depending upon the selected direction of the diode (current director) with respect to the secondary winding of the transformer relay. In a preferred embodiment the diode will be oriented to disconnect (turn off) a functional load connected to the load switch of the transformer relay or to connect (turn on) an indicator for the purpose of indicating the momentary loss of power.

In an alternative embodiment the control circuit described above has, in addition, a diode oppositely connected to the first diode connected across both the first diode and the capacitor. This control circuit may then be coupled in series with the secondary winding of the transformer relay and with other control circuits controlling the transformer relay such as a bidirectional switch as described in the Baker et al. patent. The series connected diode and capacitor will again momentarily allow the other control device connected to the transformer relay to control the transformer relay. However, once the capacitor becomes charged control in that direction will be discontinued. The oppositely connected diode, however, will allow complete control of the transformer relay in the opposite direction. The control circuit coupled in this manner may be useful where there are multiple bidirectional switches coupled in the secondary winding circuit which may be simultaneously activated in opposite directions. The circuit would then only momentarily allow control in one of the direction and prevent unwanted, repeated switching (chatter) of the transformer relay between its two stable positions.

BRIEF DESCRIPTION OF THE DRAWINGS

The foregoing advantages, construction and operation of the present invention will become more readily apparent from the following description and accompanying drawings in which.

DESCRIPTION OF THE PREFERRED EMBODIMENTS

Figure 1:
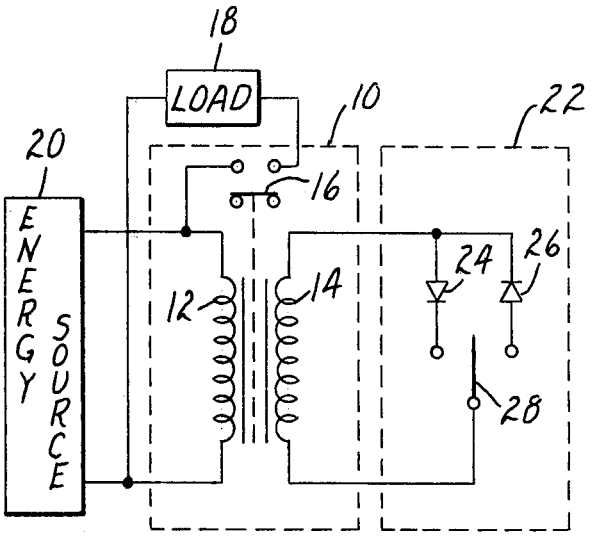
FIG. 1 PRIOR ART
FIG. 1 is a schematic diagram of a prior art transformer relay.

FIG. 1 illustrates a typical transformer relay as described in the Bollmeier patent and the Baker et al. patent. The figure shows a transformer relay 10 having a primary winding 12 and a secondary winding 14. The transformer relay 10 has a load switch 16 coupled to a load 18. The primary winding 12 is also connected to an alternating current energy source 20. The secondary winding 14 is connected to a bidirectional switch 22. The bidirectional switch 22 contains two diodes 24 and 26 and a single pole, double throw switch 28. The transformer relay 10 is magnetically latchable in either of two stable states, with the load switch 16 either "on" or "off." The direction of the unidirectional flow of current in the secondary winding 14 determines to which stable state the transformer relay 10 will be controlled. When the single pole, double throw switch 28 is momentarily thrown to the left, diode 24 will allow a unidirectional flow of current through the secondary winding 14 from bottom to top in the figure while a momentary action of the single pole, double throw switch 28 to the right will cause diode 26 to control the current flow in the secondary winding 14 from top to bottom. Note that only two wire control is required from the secondary winding 14 of the transformer relay 10 to the bidirectional switch 24.

Figure 2:
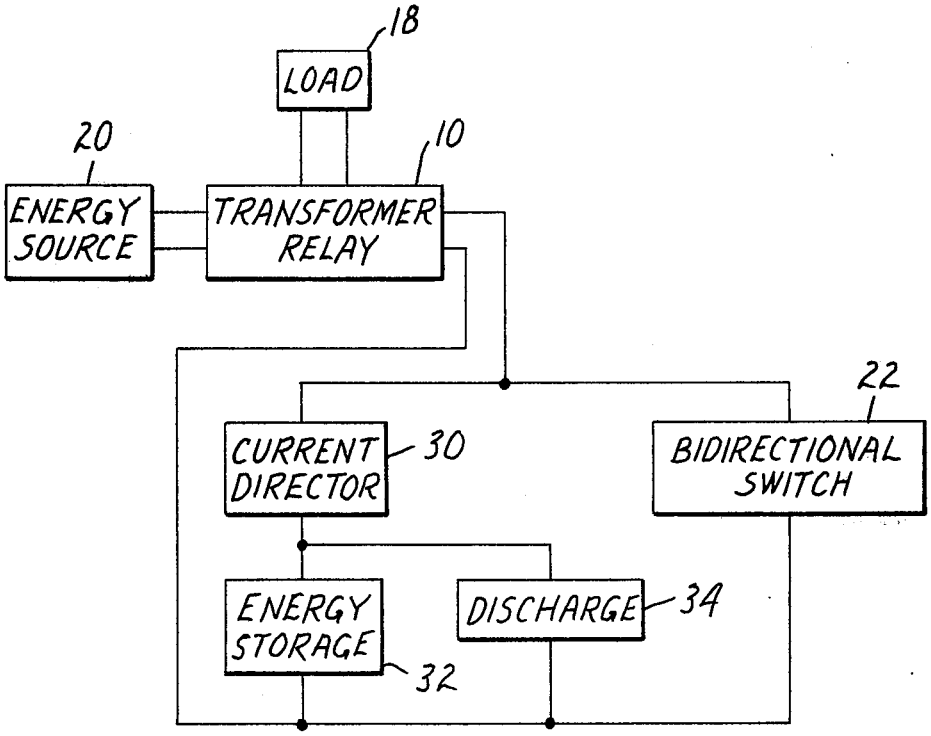
FIG. 2 is a block diagram of the present invention.

FIG. 2 is a block diagram of the transformer relay 10, the load 18, the energy source 20, and the bidirectional switch 22 illustrated in FIG. 1. FIG. 2 also contains a block diagram representation of the control circuit of the present invention. In FIG. 2 a current direction means 30 and an energy storage means 32 are coupled in series across the secondary winding 14 of the transformer relay 10. Further, in a preferred embodiment the control circuit also includes a discharge means 34 coupled across the energy storage means 32. Coupled in this manner whenever the energy souce 20 applies power to the transformer relay 10, the current direction means 30 will allow a unidirectional flow of current through the energy storage means 32 also creating a unidirectional flow of current through the secondary winding 14 of the transformer relay 10. As this unidirectional flow of current continues, the energy storage means 32 will become charged and the rate of current flow will diminish as the energy storage means 32 is charged. The time period from initial activation of the energy source 20 until the energy storage means 32 becomes charged results in the momentary application of a unidirectional flow of current to the secondary winding 14 of the transformer relay 10. This will allow the control of the state of the transformer relay 10 to the state determined by the direction of current flow as determined by the current direction means 30. The energy storage means 32 will continue to be charged as long as the energy source 20 continues to supply power to the transformer relay 10. If the energy source 20 should fail or be disconnected from the transformer relay 10, energy storage means 32 will discharge through discharge means 34. Once the energy storage means 32 is sufficiently discharged, the operation of the control circuit may repeat itself.

While energy storage means 32 is charged, full control is retained in the secondary winding 14 of the transformer relay 10 by other means. Bidirectional switch 22 may fully control the transformer relay 10 as if the control circuit of the present invention were not ;connected.

Figure 3:
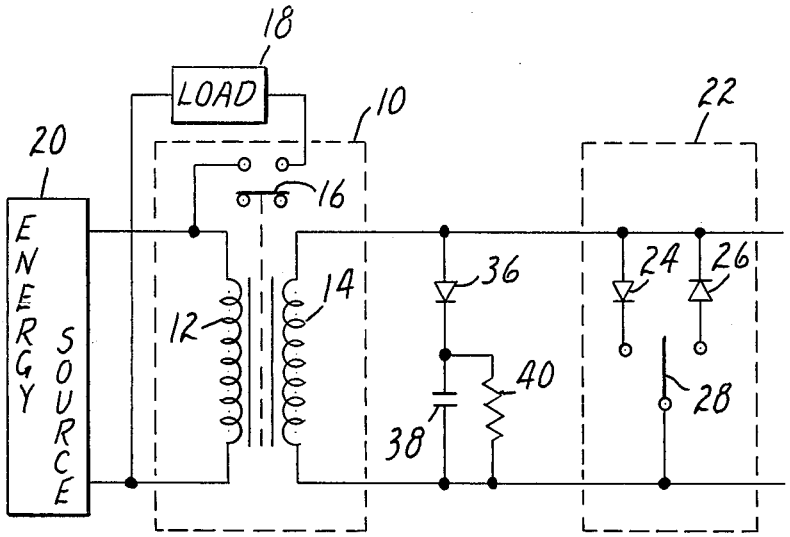
FIG. 3 is a schematic diagram of a preferred embodiment of the present invention.

FIG. 3 is a schematic representation of the control circuit of the present invention coupled across the secondary winding 14 of a transformer relay 10. The figure also illustrates primary winding 12 and the load switch 16 of transformer relay 10. The load switch 16 is coupled to load 18 and the primary winding 12 is coupled to the alternating current energy source 20. As in FIG. 2 the secondary winding 14 of the transformer relay 10 is coupled to bidirectional switch 22. Bidirectional switch 22 is identical with the bidirectional switch 22 in FIG. 1, again containing diodes 24 and 26 and single pole, double throw switch 28. In FIG. 3 the current direction means 30 has been replaced with diode 36. The energy storage means 32 has been replaced with capacitor 38 and the discharge means 34 has been replaced with resistor 40. When the energy source 20 is activated or energized, diode 36 will allow unidirectional current to charge capacitor 38 and allow a momentary unidirectional current flow through the secondary winding 14 of the transformer relay 10 from the bottom to the top in FIG. 3. The capacitor 38, once charged, will not allow further current flow. The failure or disconnection of the energy source 20 from the primary winding 12 of the transformer relay 10 will result in the capacitor 38 being discharged. Capacitor 38 will discharge through resistor 40 acting as a discharge means. The rate of discharge and therefore the time before the control circuit will again be ready to control the transformer relay 10 upon activation of the control circuit is, of course, determined by the RC time constant of resistor 40, capacitor 38 and the resitive properties of the secondary winding 14 and the interconnecting wiring. The presence of resistor 40 ensures the prompt discharge of capacitor 38 making it then available for the re-energization or activation or connection of energy source 20 to the transformer relay 10.

It should also be noted that the resistor 40 connected in FIG. 3 that a continual unidirectional current flow will occur through the secondary winding 14 of the transformer relay 10 through the path of diode 36 and resistor 40. As indicated above, the transformer relay 10 has a threshold above which the unidirectional flow of current must exceed in order to allow switching of the transformer relay 10 to occur. With the proper sizing of resistor 40 the current passing through diode 36 and resistor 40 can be kept below that threshold insuring only the momentary control of the transformer relay 10.

In the schematic representation of FIG. 3, the energy storage means 32 of FIG. 2 is illustrated as capacitor 38. While a capacitor is the preferred element for energy storage means 32, it is not the only one available. Alternative energy storage means such as a battery could also be provided and are within the scope of the present invention. In the same manner current director 30 of FIG. 2 is illustrated in FIG. 3 as a diode. Of course, alternative components and complex circuitry could be substituted for diode 36 which allows only for the passage of a unidirectional flow of current. It is contemplated to be within the scope of the present invention that alternative circuit arrangements for diode 36 may be substituted which allow a unidirectional flow of current.

Figure 4:
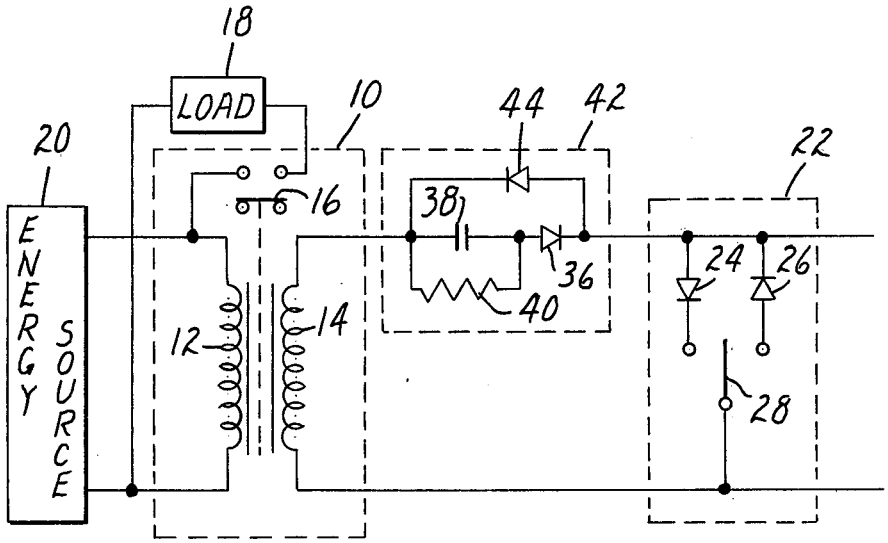
FIG. 4 is a schematic diagram of an alternative embodiment of the present invention.

FIG. 4 is a schematic diagram of an alternative embodiment of the present invention. Again a transformer relay 10 is provided having a primary winding 12, a secondary winding 14 and a load switch 16. Again, the load switch 16 is coupled to a load 18 and the primary winding 12 is coupled to an alternating current energy source 20. Similarly bidirectional switch 22 is shown connected in the circuit containing the secondary winding 14 of the transformer relay 10. Bidirectional switch 22 includes again diodes 24 and 26 and a single pole, double throw switch 28. FIG. 4 also includes the control circuit 42 of the present invention. The control circuit 42 in FIG. 4 differs slightly from the control circuit illustrated in FIG. 3. The control circuit 42 includes diode 36, capacitor 38 and resistor 40. The control circuit 42 also includes diode 44 oppositely oriented with respect to diode 36 and coupled across the entire series connection of diode 36 and capacitor 38. The control circuit 42 is itself coupled in series with the bidirectional switch 22 and the secondary winding 14 of the transformer relay 10. This is contrasted to the control circuit in FIG. 3 which is coupled directly across the secondary winding 14 of the transformer relay 10. Connected as in FIG. 4, the control circuit 42 provides for the momentary control of the transformer relay 10 upon the activation of the control circuit 42 as in the previous example. The primary difference in operation between FIG. 3 and FIG. 4 is that the activation of the control circuit 42 occurs not upon the energization or activation of the energy source 20 or the application of the energy source 20 to the primary winding 12 of the transformer relay 10, but rather upon the completion of the circuit containing the secondary winding 14 of transformer relay 10. In FIG. 4 this could occur when the bidirectional switch 22 was activated. If the single pole, double throw switch 28 is thrown to the left in FIG. 4 current would flow through diode 24 and would activate the control circuit 42. Without control circuit 42, diode 24 would allow a repeated unidirectional flow of current through the secondary winding 14. With the addition of control circuit 42 in the schematic, capacitor 38 will charge thus allowing a momentary unidirectional flow of current through the secondary winding 14 and a momentary control of the transformer relay 10. If the single pole, double throw switch 28 of the bidirectional switch 22 were thrown to the right, diode 26 would allow unidirectional flow of current in the opposite direction through the secondary winding 14. Here the control circuit 42 would have no effect on the operation since diode 44 bypasses capacitor 38 and would allow control of the transformer relay 10.

A function of the control circuit 42 in FIG. 4 becomes clear if a plurality of bidirectional switches 22 were coupled in the circuit containing the secondary winding 14 of the transformer relay 10. The simultaneous operation of bidirectional switches 22 in opposite directions would otherwise result in the repeated switching of the transformer relay 10 following the waveform of the alternating current energy source 20. With the control circuit 42 coupled with the secondary winding 14 of the transformer relay 10, control is maintained in only one direction, thus discontinuing the repeated switching of the transformer relay 10 before deleterious effects within the transformer relay 10 could occur.

While one control circuit 42 is illustrated in FIG. 4, it is recognized and understood that a plurality of control circuits 42 would be coupled in series with the secondary winding 14 and other bidirectional switches 22 or other control means, achieving the same results. The additional control circuits 42 could be coupled in the same direction or in the opposite direction. If coupled in the opposite direction, of course, only momentary control would be allowed in both directions of control of the transformer relay 10.

Exemplary component identification of values are indicated in Table I:

| Reference Numeral | Component | Type No. or Values |
|---|---|---|
| 24 | Diode | 1N4004 |
| 26 | Diode | 1N4004 |
| 36 | Diode | 1N4004 |
| 38 | Capacitor | 150 microfarads, |
| 40 | Resistor | 6.8 kilohms |
| 44 | Diode | 1N4004 |

Thus, it can be seen that there has been shown and described a novel control circuit for controlling a transformer relay. It is to be understood, however, that various changes, modifications, and substitutions in the form and the details of the described control circuit can be made by those skilled in the art without departing from the scope of the invention as defined by the following claims.

What is claimed is:

1. A control circuit in combination with a transformer relay, said transformer relay having a primary winding adapted to be coupled to an alternating current energy source, having a load switch adapted to control the application of said energy source to a load, and having a secondary winding which controls said load switch to a selected position depending upon current flow in said secondary winding above a predetermined switching threshold in a selected direction, comprising;

first current directing means for allowing a flow of current in one direction only;

energy storage means for momentarily allowing a current flow upon application of energy before becoming charged; and discharge means coupled to said energy storage means, and discharge means for allowing said energy storage means to substantially discharge while said control circuit is not activated;

said energy storage means and said first current directing means being coupled in series and being adapted to be coupled with said secondary winding of said transformer relay;

whereby current is momentarily allowed to flow in a selected direction in said secondary winding above said predetermined switching threshold upon activation of said control circuit, and whereby said load switch of said transformer relay is controlled to a selected position upon activation of said control circuit.

2. A control circuit as in claim 1 wherein said energy storage means and said first current directing means are coupled across said secondary winding of said transformer relay whereby said transformer relay is controlled to a selected position upon energization of said primary winding of said transformer relay.

3. A control circuit as in claim 2 wherein said energy storage means is a capacitor.

4. A control circuit as in claim 3 wherein said first current directing means is a diode.

5. A control circuit as in claim 4 wherein said discharge means is a resistor.

6. A control circuit as in claim 1 which further comprises a bidirectional switch coupled across said secondary winding of said transformer relay; said energy storage means and said first current directing means being coupled in series with and between said secondary winding and said bidirectional switch; and which further comprises a second current directing means for allowing a flow of current in one direction only, said second current directing means being coupled across both said first current directing means and said energy storage means, said second current directing means being oriented oppositely to said first current directing means.

7. A control circuit as in claim 6 wherein said energy storage means is a capacitor.

8. A control circuit as in claim 7 wherein said first current directing means and said second current directing means are diodes.

9. A control circuit as in claim 8 wherein said discharge means is a resistor.

10. A control system coupled to a load, comprising:

a transformer relay having a primary winding adapted to be coupled to an alternating current energy source and having a secondary winding which controls a load switch to a selected position depending upon current flow in said secondary winding above a predetermined switching threshold in a selected direction, said load switch coupled to said load;

first current directing means for allowing a flow of current in one direction only;

energy storage means for momentarily allowing a current flow upon application of energy before becoming charged; and discharge means coupled to said energy storage means, said discharge means for allowing said energy storage means to substantially discharge while energy is not applied to said control system;

said energy storage means and said first current directing means being coupled in series and being coupled with said secondary winding of said transformer relay;

whereby said load switch of said transformer relay is controlled to a selected position upon activation of a circuit containing said energy storage means and said first current directing means.

11. A control system as in claim 10 wherein said energy storage means and said first current directing means are coupled across said secondary winding of said transformer relay whereby said transformer relay is controlled to a selected position upon energization of said primary winding of said transformer relay.

12. A control system as in claim 11 wherein said energy storage means is a capacitor.

13. A control system as in claim 12 wherein said first current directing means is a diode.

14. A control system as in claim 13 wherein said discharge means is a resistor.

15. A control system as in claim 10 which further comprises a bidirectional switch coupled across said secondary winding of said transformer relay; said energy storage means and said first current directing means being coupled in series with and between said secondary winding and said bidirectional switch; and which further comprises a second current directing means for allowing a flow of current in one direction only, said second current directing means being coupled across both said energy storage means and first current directing means, said second current directing means being oriented oppositely to said first current directing means; whereby said bidirectional switch is momentarily allowed to switch said transformer relay to a selected position.

16. A control system as in claim 15 wherein said energy storage means is a capacitor.

17. A control system as in claim 16 wherein said first current directing means and said second current directing means are diodes.

18. A control system as in claim 17 wherein said discharge means is a resistor.

* * * * *

UNITED STATES PATENT AND TRADEMARK OFFICE

CERTIFICATE OF CORRECTION

PATENT NO. : 4,433,356

DATED : February 21, 1984

INVENTOR(S) : Gerald A. Wyatt

It is certified that error appears in the above—identified patent and that said Letters Patent is hereby corrected as shown below:

Col 4, line 61, "the" should read --with--.

Col 3, line 8, "direction" should read --directions--.

Col 6, line 36, insert --25 volts-- after "microfarads,".

Signed and Sealed this

Fourth Day of September 1984

[SEAL]

*Attest:*

*Attesting Officer*

GERALD J. MOSSINGHOFF

*Commissioner of Patents and Trademarks*